United States Patent [19]

Kabbaby

[11] Patent Number: 4,642,100

[45] Date of Patent: Feb. 10, 1987

[54] SHOWER-MOUNTED DOUCHE APPARATUS

[76] Inventor: Charles B. Kabbaby, 4290 S.W. 109th Ave., Davie, Fla. 33328

[21] Appl. No.: 772,766

[22] Filed: Sep. 5, 1985

Related U.S. Application Data

[63] Continuation-in-part of Ser. No. 707,733, Mar. 4, 1985.

[51] Int. Cl.[4] ..... A61M 37/00

[52] U.S. Cl. ..... 604/150

[58] Field of Search ..... 604/150, 259, 246, 279, 604/280; 239/318

[56] References Cited

U.S. PATENT DOCUMENTS

| | | | |
|---|---|---|---|
| 964,730 | 7/1910 | Ackerman . | |
| 1,861,932 | 6/1932 | Moore . | |
| 1,940,210 | 12/1933 | Frederick | 128/229 |
| 3,042,314 | 7/1962 | Packard et al. | 239/347 |
| 3,104,664 | 9/1963 | Ladd | 128/229 |
| 3,225,759 | 12/1965 | Drapen et al. | 604/150 |
| 3,254,647 | 6/1966 | Vogel | 128/229 |
| 3,373,744 | 3/1968 | Kendall | 128/229 |
| 3,399,676 | 9/1968 | McLaughlin | 128/229 |
| 3,461,870 | 8/1969 | Van Linge | 128/229 |
| 3,512,525 | 5/1970 | Crowley, Jr. et al. | 604/150 |
| 3,847,150 | 11/1974 | Scheuermann | 128/229 |
| 4,000,742 | 1/1977 | DiGiacomo | 128/229 |
| 4,043,337 | 8/1977 | Baugher | 128/229 |
| 4,349,157 | 9/1982 | Beiswenger et al. | 239/509 |

FOREIGN PATENT DOCUMENTS 1182266 1/1959 France .

*Primary Examiner*—John D. Yasko

*Attorney, Agent, or Firm*—Oltman and Flynn

[57] ABSTRACT

An improved shower-mounted douche apparatus features a high pressure safety design comprising a flow restricting orifice affixed in the entry passageway of the douche bottle mixing head assembly. Increased venturi action is needed to operate a proper mix using the reduced mixing head pressure. The increased venturi action is obtained by narrowing the siphon tube near the entrance to the mixing head. A further ease of use feature consists of a push pull two position valve which allows quick and easy selection of using either the shower head or douche attachment.

2 Claims, 7 Drawing Figures

FIG. 3
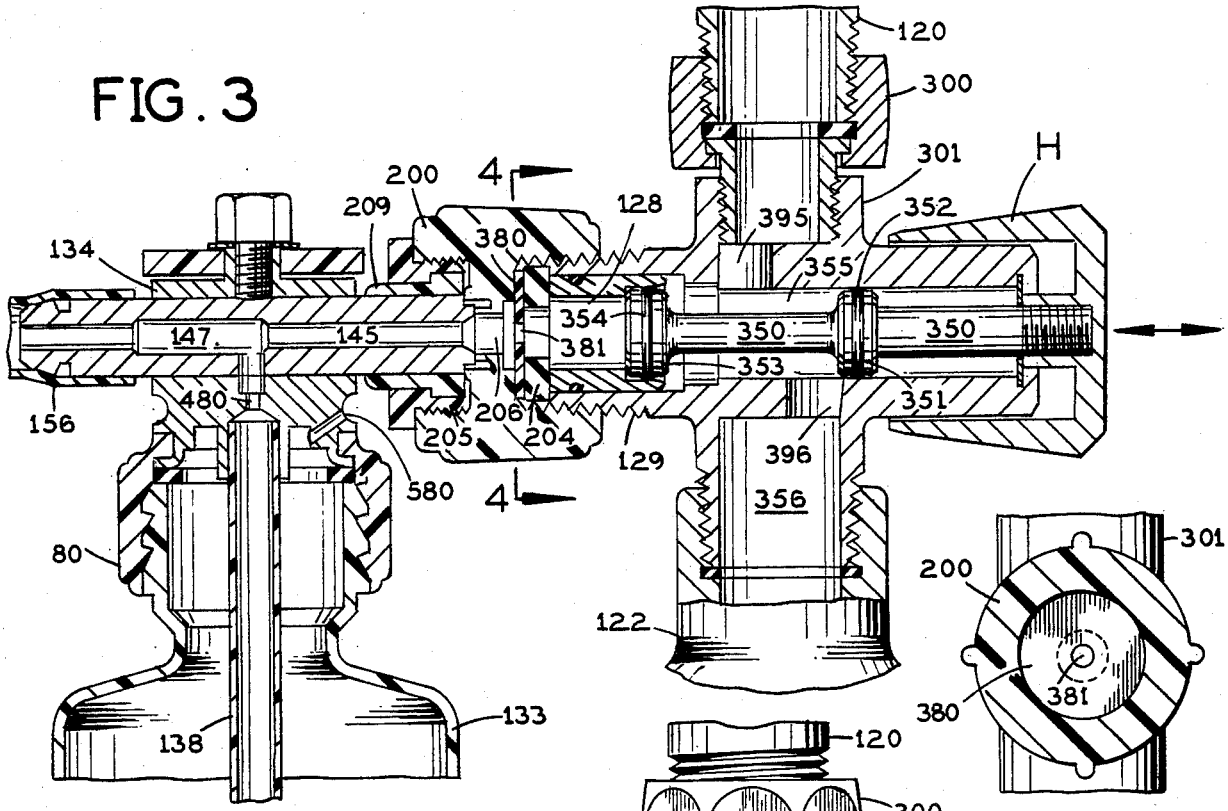
FIG. 4
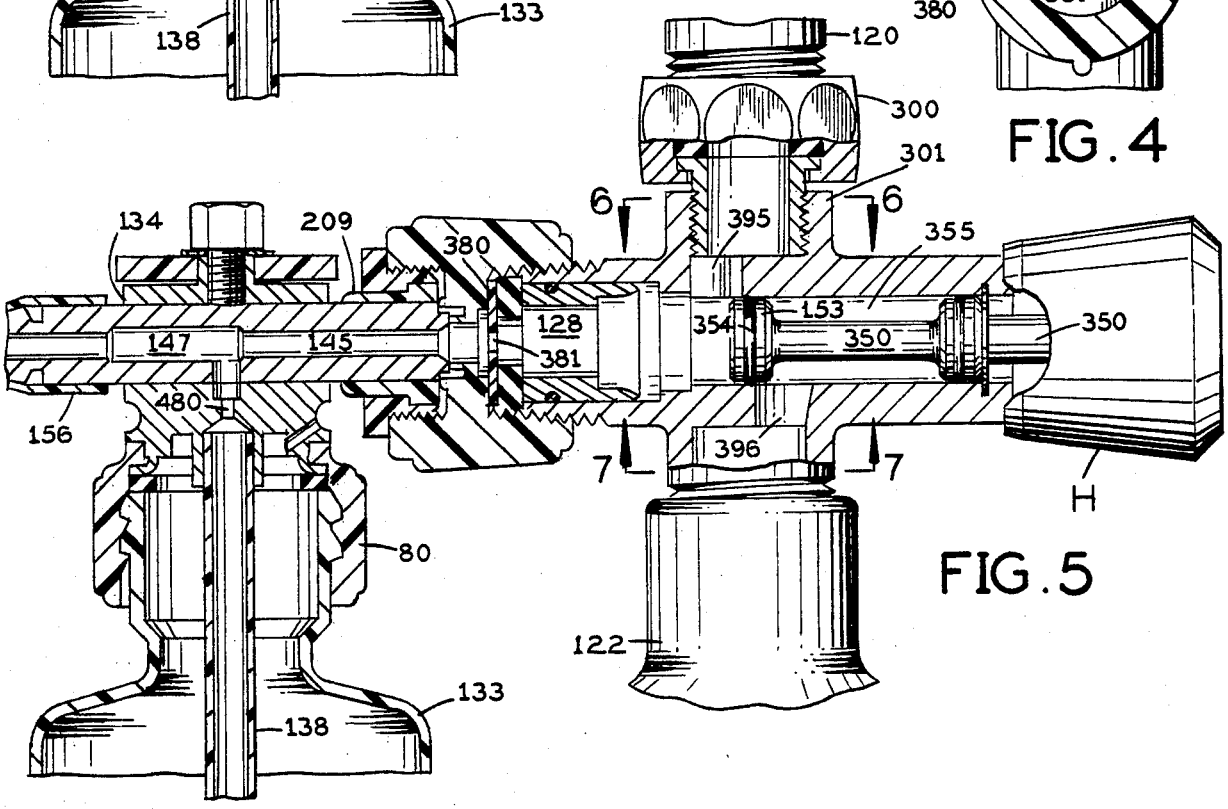
FIG. 5
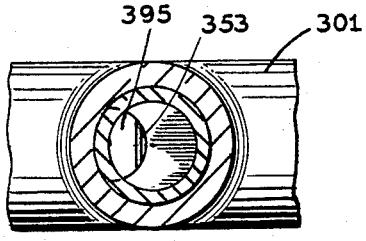
FIG. 6
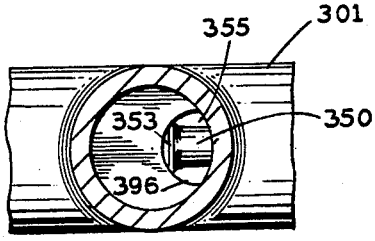
FIG. 7

SHOWER-MOUNTED DOUCHE APPARATUS

RELATED APPLICATION

This application is a continuation-in-part of pending application Ser. No. 06/707,733 filed Mar. 4, 1985, by the present inventor.

SUMMARY OF THE INVENTION

This invention improves upon the working efficiency of this inventor's application Ser. No. 06/707,733 filed Mar. 4, 1985. The present invention is, therefore, an improved shower mounted douche apparatus for applying simultaneously water and douche medicament withdrawn from a container.

The present invention comprises the structural improvements to the above named patent. They are:

(1) A push pull bypass valve replacing the former handle driven rotating valve.

(2) A pressure restricting safety orifice on thee input side of the douche medicament container functions to prevent injury to the user who might otherwise apply too much water pressure during use.

(3) An improved narrower exit bore hole from the douche medicament bottle increases the venturi mixing effect while operating under the decreased pressure drop caused by the safety washer.

The principal object of this invention is to provide a safety mechanism on a shower mounted douche apparatus that prevents excess pressure during use.

Another object of this invention is to increase the ease of use of a shower mounted douche apparatus by adding a push-pull control valve.

Other objects of this invention will appear from the following description and appended claims, reference being had to the accompanying drawings forming a part of this specification wherein like reference characters designate corresponding parts in the several views.

DESCRIPTION OF THE DRAWINGS

FIG. 3 is a front plan view, with parts broken away, of the assembly shown in FIG. 1.

FIG. 4 is a vertical section taken along the line 4—4 in FIG. 3.

FIG. 5 is the same view as FIG. 3 but with the push pull handle in the pulled position allowing water to flow through the douche apparatus.

FIG. 6 is a horizontal section taken along line 6—6 in FIG. 5 showing the valve opening passage.

FIG. 7 is a horizontal section taken along line 7—7 in FIG. 5 showing the valve opening passage.

DETAILED DESCRIPTION

Figure 1:
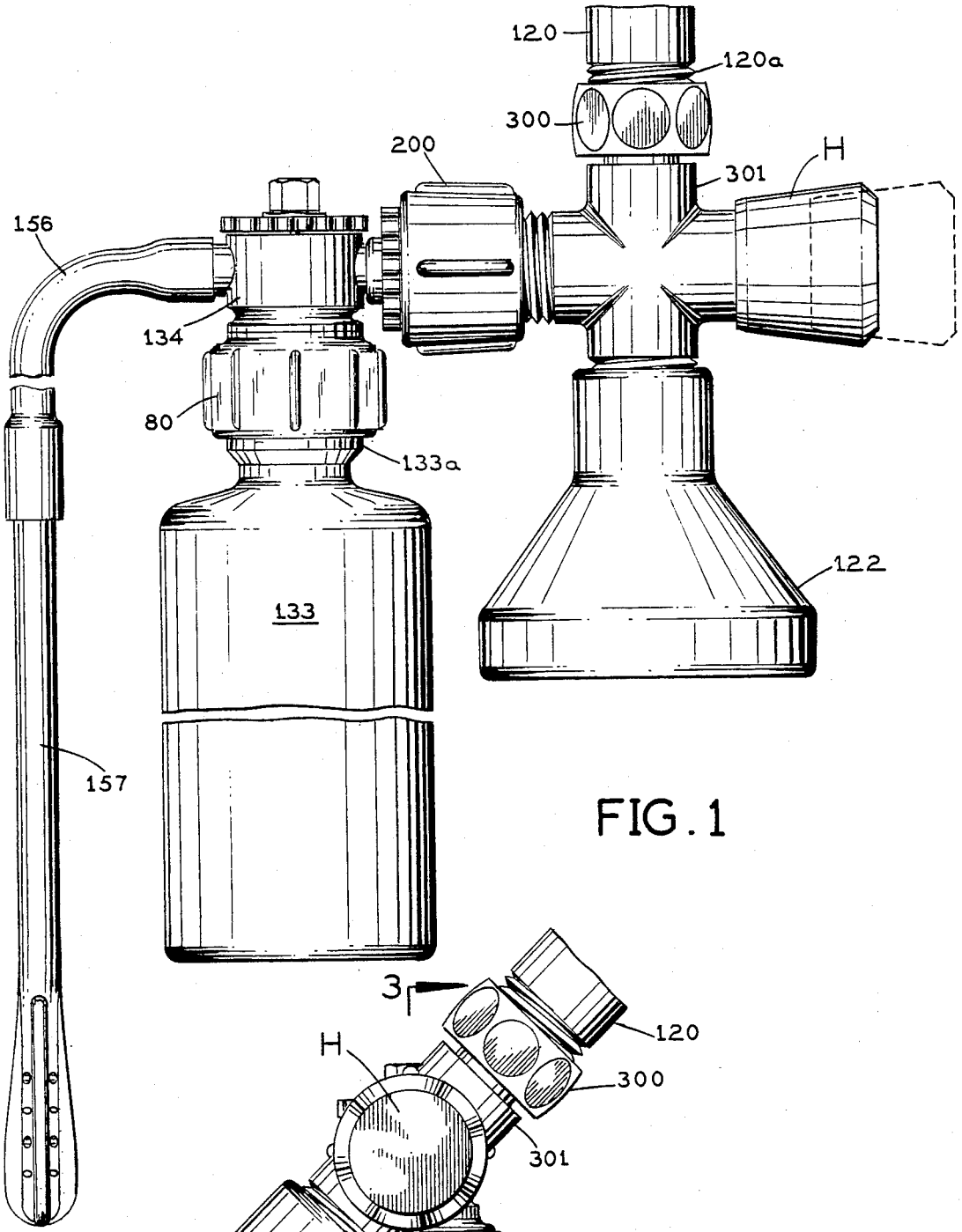
FIG. 1 is a side elevation of a bathroom shower equipped with an improved-mounted douche apparatus.

Referring to FIG. 1, a typical shower in a residence, hotel or motel has a rigid water supply pipe 120 with external threads at 120*a*. Normally the shower head 122 of known design would be directly mounted on the water supply pipe 120. In the present invention a commercially available two-way valve 301 with push pull handle H is mounted to supply pipe 120 and the shower head 122 is mounted to one position of the two way valve 301. Nut 300 secures valve 301 to pipe 120.

Double socketed ring 200 of suitable plastic is screwed to the second valve opening of valve 301. The mixing head 134, which is commercially available, is attached to the top neck of the medicament container bottle 133 by a separate plastic ring 80 which is internally screw-threaded at the bottom for threaded attachment to the container bottle neck 133*a*. A long flexible hose 156 of rubber-like material connects to mixing head 134. A douche applicator spray device 157 of known design is fastened to the opposite end of hose 156.

Figure 2:
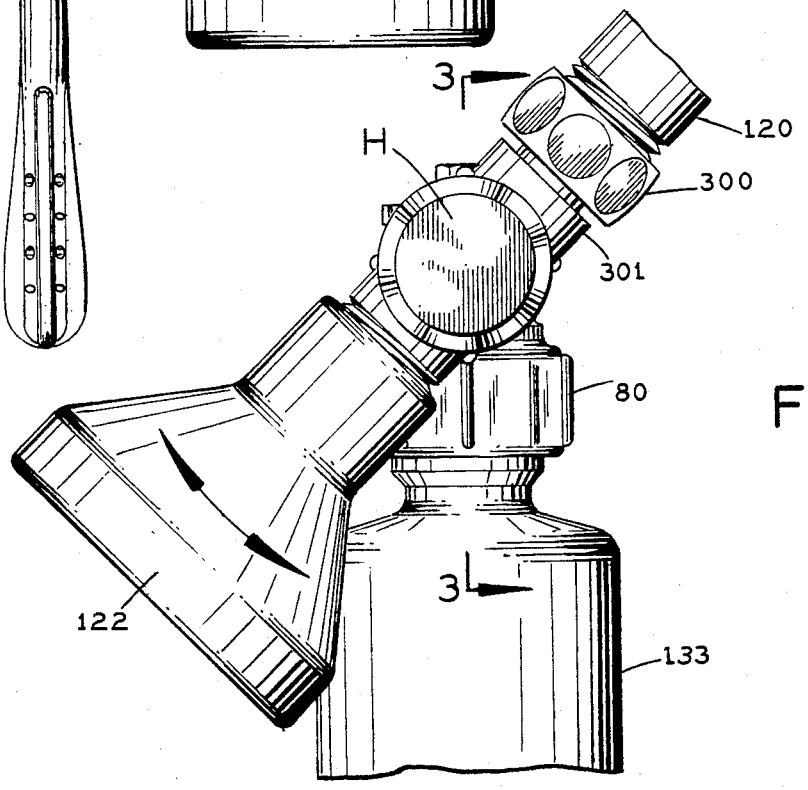
FIG. 2 is an end elevation taken from the right end of FIG. 1.

FIG. 2 is an end view of the right side of FIG. 1 showing the handle H shower head 122 and the above named parts in FIG. 1.

FIG. 3 shows handle H in the pushed in position which allows water to flow through hole 395 into passage 355 around rod 350 through hole 396 and into passage 356 and through shower head 122. Rod ridge 351 and O ring 352 prevent the water from flowing out the handle. Rod ridge 353 and O ring 354 prevent water from flowing to the douche apparatus.

The end of valve body projection 129 sealingly engages double socketed ring 200. Rubber washer 204 prevents leakage. Water passage 128 is greatly restricted by orifice 380 which has an aperture 381 of approximately one tenth inch diameter. After passing through aperture 381, water passes through central opening 206 of ring 200, then through venturi water inlet passage 145 in mixing head 134. O ring 205 of rubber-like material and sleeve 209 secure the mixing head 134 to the ring 200.

Water passing by the top of siphon tube 138 pulls the douche medicament from bottle 133. The novel siphon tube restrictor 480 increases the flow of medicament up the siphon tube 138 into the mixing head 134, out the exit passage 147 and into the hose 156. The air vent 580 adds to the efficiency of the venturi action by preventing a vacuum lock in bottle 133.

Thus the present invention has improved on patent application Ser. No. 06/707,733 filed Mar. 4, 1985 by lowering the maximum pressure capable of passing through orifice 380 thus preventing accidental injury to the user. At the same time, added efficiency to the venturi mixing action is gained by siphon tube restrictor 480. These improvements maintain a satisfactory degree of medicament mixing at lower pressures.

FIG. 4 is a vertical section showing the pressure reducing orifice 380 in place in ring 200.

FIG. 5 shows the handle H in the pull position allowing water to flow through hole 395 and through water passage 128 and to the douche apparatus. O ring 354 and rod ridge 353 block the water passage to the shower head 122.

FIG. 6 shows hole 395 and the tip of rod ridge 353 blocking the water flow.

FIG. 7 shows hole 396 and the base of rod ridge 353 and rod 350 and empty water passage 355.

I claim:

1. For use with a shower apparatus having:

a water supply pipe with an outlet end, and a shower head detachably connected to said outlet end of the water supply pipe, an improved douche apparatus, comprising:

a valve having a valve body with an upper end and a lower end, means on the upper end of said valve body for attaching it to said outlet end of the water supply pipe, means on the lower end of said valve body for attaching it to the shower head, a valve member in said valve body selectively adjustable between a first position in which it establishes a first water flow path from said water supply pipe to said shower head and a second position in which it blocks said first water flow path, said valve body on one side thereof having a laterally extending neck which provides a branch passage extending from said valve member to receive water from said water supply pipe in said second position of the valve member;

a container assembly for holding a liquid douche medicament;

a fitting connecting said container assembly to said laterally extending neck of said valve body for passing water from said branch passage of said valve body;

said fitting further comprising an internal water passage and a flow restricting orifice;

means in said container assembly for mixing said liquid medicament with the water from said fitting; and an applicator operatively connected to said container assembly for discharging the mixture of water and said liquid medicament;

said container assembly comprising:

a mixing head coupled to said fitting;

a container vessel having an air vent below said mixing head;

said laterally extending neck on the valve body, said fitting and said mixing head being dimensioned to position said container vessel completely to one side of the shower head; and a siphon tube extending down into said container vessel having a constricted neck near the entrance to said mixing head functioning to provide venturi action to pull said medicament from said container assembly into said mixing head, thereby thoroughly mixing said medicament with the water prior to discharge of the mixture from the

2. The improved douche apparatus of claim 1, wherein said valve has a push pull handle as the means for selecting either the first or second valve position.

* * * * *

UNITED STATES PATENT AND TRADEMARK OFFICE

CERTIFICATE OF CORRECTION

PATENT NO. : 4,642,100

DATED : February 10, 1987

INVENTOR(S) : Charles B. Kabbaby

It is certified that error appears in the above-identified patent and that said Letters Patent is hereby corrected as shown below:

Claim 1, last line, at the end of the line, insert

-- applicator. --

Signed and Sealed this

Twenty-ninth Day of September, 1987

*Attest:*

DONALD J. QUIGG

*Attesting Officer* *Commissioner of Patents and Trademarks*